US012753955B2

(12) United States Patent
Vaisman

(10) Patent No.: US 12,753,955 B2
(45) Date of Patent: Oct. 6, 2026

(54) VAPOR COMPRESSION AND ABSORPTION REFRIGERATION CYCLE (VCARC)

(71) Applicant: Effusio, LLC, Knoxville, TN (US)

(72) Inventor: Igor Vaisman, Carmel, IN (US)

(73) Assignee: Effusio, LLC, Knoxville, TN (US)

( * ) Notice: Subject to any disclaimer, the term of this patent is extended or adjusted under 35 U.S.C. 154(b) by 212 days.

(21) Appl. No.: 18/639,416

(22) Filed: Apr. 18, 2024

(65) Prior Publication Data

US 2024/0353156 A1 Oct. 24, 2024

Related U.S. Application Data

(60) Provisional application No. 63/460,531, filed on Apr. 19, 2023.

(51) Int. Cl.
*F25B 25/00* (2006.01)
*F25B 41/28* (2021.01)
*F25B 41/325* (2021.01)

(52) U.S. Cl.
CPC ..... *F25B 25/005* (2013.01); *F25B 41/28* (2021.01); *F25B 41/325* (2021.01); *F25B 2400/16* (2013.01)

(58) Field of Classification Search
CPC ..... F25B 25/005; F25B 30/00; F25B 30/02; F25B 30/04; F25B 41/325; F25B 41/28;
(Continued)

(56) References Cited

U.S. PATENT DOCUMENTS

2006/0112712 A1* 6/2006 Chang ..... F25B 25/005 62/434
2016/0223234 A1* 8/2016 Vaisman ..... F25B 49/005
2022/0357082 A1* 11/2022 Unton ..... F25B 25/005

FOREIGN PATENT DOCUMENTS

CN 102322705 A * 1/2012
CN 112880230 A * 6/2021 ..... F25B 49/043
WO WO-2011027350 A2 * 3/2011 ..... F24F 3/1417

OTHER PUBLICATIONS

English translation of Li et al. (CN 102322705 A) (Year: 2012).*
English translation of Zhang et al. (CN-112880230-A) (Year: 2021).*

* cited by examiner

*Primary Examiner* — Miguel A Diaz
(74) *Attorney, Agent, or Firm* — Fishman Stewart PLLC

(57) ABSTRACT

A thermal system may include a vapor compression refrigeration circuit conducting a first refrigerant, an absorption refrigeration circuit conducting a second refrigerant and an absorbent, and a heat exchanger unit. The vapor compression refrigeration circuit may include a first heat rejection heat exchanger, a first heat absorption heat exchanger, a compressor disposed between the first heat absorption heat exchanger and the first heat rejection heat exchanger, and an expansion valve disposed between and connected to the first heat rejection heat exchanger and the first heat absorption heat exchanger. The absorption refrigeration circuit may include a generator, an absorber, a pump disposed between and connected to the absorber and the generator, a throttling valve disposed between and connected to the generator and the absorber, a second heat rejection heat exchanger connected to the generator, and a second heat absorption heat exchanger connected to the absorber. The generator and the first heat rejection heat exchanger may be integrated with one another within the heat exchanger unit such that heat emitted by the first heat rejection heat exchanger is transferred to the generator.

20 Claims, 7 Drawing Sheets

(58) Field of Classification Search
CPC ..... F25B 2400/16; F25B 15/00; F25B 17/00;
F25B 2315/006
See application file for complete search history.

VAPOR COMPRESSION AND ABSORPTION REFRIGERATION CYCLE (VCARC)

CROSS-REFERENCE TO RELATED APPLICATIONS

This application claims priority to U.S. Provisional Patent Application No. 63/460,531, filed on Apr. 19, 2023, the contents of which is hereby incorporated by reference in its entirety.

TECHNICAL FIELD

The present disclosure generally relates to thermal systems for providing heating and cooling, such as thermal systems including a vapor compression refrigeration circuit and an absorption refrigeration circuit.

BACKGROUND

In at least some thermal systems, when evaporating temperature reduces or condensing temperature increases, a compressor suction pressure reduces, the compressor mass flow rate reduces, compressor power per unit of mass flow rate increases, and cooling (i.e., evaporating) or heating (i.e., condensing) capacity reduces. As a result, the coefficient of performance (COP) of cooling and/or the COP of heating degrades.

In at least some basic vapor compression systems, a compressor power and an evaporator capacity are sensitive to saturated suction and discharge temperatures (SST and SDT). A low SST or high SDT generally necessitates the compressor be larger and/or more robust and places a high demand of compressor power per kW of cooling capacity. Therefore, systems (e.g., heat pumps) operating in cold climate or systems (e.g., refrigeration systems) cooling at extremely low temperatures need to utilize excessive electrical power to pump vapor.

The challenge facing heat pumps in cold climates include very low evaporating pressures and/or temperatures in outdoor units resulting in significant reduction of evaporator condensing/heating capacity and, at the same time, significant increase of electrical power demand per 1 kW. Development of heat pumps that efficiently operate in cold climates may allow transition from fossil fuels to green refrigerants in industrial, commercial, and residential applications.

The challenge facing air-conditioning and refrigeration systems in hot climates include very high condensing pressures and/or temperatures in outdoor units resulting in significant reduction of evaporator capacity and, at the same time, significant increase of electrical power demand per 1 kW. Development of air-conditioning and refrigeration that efficiently operate in hot climates may improve efficiency of industrial, commercial, and residential applications.

Rankine cycle and supercritical power generation systems operate between certain high (turbine inlet) and low (turbine exit) pressures. The higher the high-to-low pressure difference or pressure ratio the higher the power output generated by the turbine. The low pressure of the Rankine cycle or the supercritical power generation systems is restricted by heat sink temperature and this restricts the increase of the pressure difference or ratio across the turbine.

Accordingly, there is a need for an innovative and improved thermal system that minimizes or eliminates one or more challenges or shortcomings of existing thermal systems.

SUMMARY

A thermal system may include a vapor compression refrigeration circuit through which a first refrigerant is flowable, an absorption refrigeration circuit through which a second refrigerant and an absorbent are flowable, and a first heat exchanger unit. The vapor compression refrigeration circuit may include a first heat rejection heat exchanger, a first heat absorption heat exchanger, a compressor disposed between the first heat absorption heat exchanger and the first heat rejection heat exchanger, and an expansion valve disposed between and connected to the first heat rejection heat exchanger and the first heat absorption heat exchanger. The absorption refrigeration circuit may include a generator, an absorber, a pump disposed between and connected to the absorber and the generator, a throttling valve disposed between and connected to the generator and the absorber, a second heat rejection heat exchanger connected to the generator, and a second heat absorption heat exchanger connected to the absorber. The second heat rejection heat exchanger may be disposed between the generator and the second heat absorption heat exchanger. The second heat absorption heat exchanger may be disposed between the second heat rejection heat exchanger and the absorber. The first heat exchanger unit may include the generator and the first heat rejection heat exchanger. The generator and the first heat rejection heat exchanger may be integrated with one another within the first heat exchanger unit such that heat emitted by the first heat rejection heat exchanger is transferred to the generator. The system may further include a second heat exchanger unit or a third heat exchanger unit. The second heat exchanger unit may include the absorber and the first heat absorption heat exchanger. The absorber and the first heat absorption heat exchanger may be integrated with one another within the second heat exchanger unit such that heat emitted by the absorber is transferred to the first heat absorption heat exchanger. The third heat exchanger unit may include the second heat rejection heat exchanger and the first heat absorption heat exchanger. The second heat rejection heat exchanger and the first heat absorption heat exchanger may be integrated with one another within the third heat exchanger unit such that heat emitted by the second heat rejection heat exchanger is transferred to the first heat absorption heat exchanger. Yet, the first heat absorption heat exchanger may be configured to provide thermal contact between the first refrigerant and the fluid stream running through the absorber and the second heat rejection heat exchanger downstream from the second heat rejection heat exchanger. Alternatively, the first heat absorption heat exchanger may be configured to provide thermal contact with any heat source emitting heat at a temperature higher than the evaporating temperature in the second heat absorption heat exchanger. In this case, the first heat absorption heat exchanger may (i) absorb heat from a low-grade waste heat or (ii) cool a high temperature source.

A thermal system may include a vapor compression refrigeration circuit through which a first refrigerant is flowable, an absorption refrigeration circuit through which a second refrigerant and an absorbent are flowable, and a heat exchanger unit. The vapor compression refrigeration circuit may include a heat rejection heat exchanger, and heat absorption heat exchanger, a compressor disposed between the heat absorption heat exchanger and the heat rejection heat exchanger, and an expansion valve disposed between and connected to the heat rejection heat exchanger and the heat absorption heat exchanger. The absorption refrigeration circuit may include a generator, an absorber, a pump disposed between and connected to the absorber and the generator, a throttling valve disposed between and connected to the generator and the absorber, and a turbine disposed between and connected to the generator and the absorber. The heat exchanger unit may include the generator and the heat rejection heat exchanger. The generator and the heat rejection heat exchanger may be integrated with one another within the heat exchanger unit such that heat emitted by the heat rejection heat exchanger is transferred to the generator. The system may further include a second heat exchanger unit. The second heat exchanger unit may include the absorber and the first heat absorption heat exchanger. The absorber and the first heat absorption heat exchanger may be integrated with one another within the second heat exchanger unit such that heat emitted by the absorber is transferred to the first heat absorption heat exchanger.

BRIEF DESCRIPTION OF THE DRAWINGS

While the claims are not limited to a specific illustration, an appreciation of various aspects may be gained through a discussion of various examples. The drawings are not necessarily to scale, and certain features may be exaggerated or hidden to better illustrate and explain an innovative aspect of an example. Further, the exemplary illustrations described herein are not exhaustive or otherwise limiting, and embodiments are not restricted to the precise form and configuration shown in the drawings or disclosed in the following detailed description. Exemplary illustrations are described in detail by referring to the drawings as follows:

DETAILED DESCRIPTION

Figure 1:
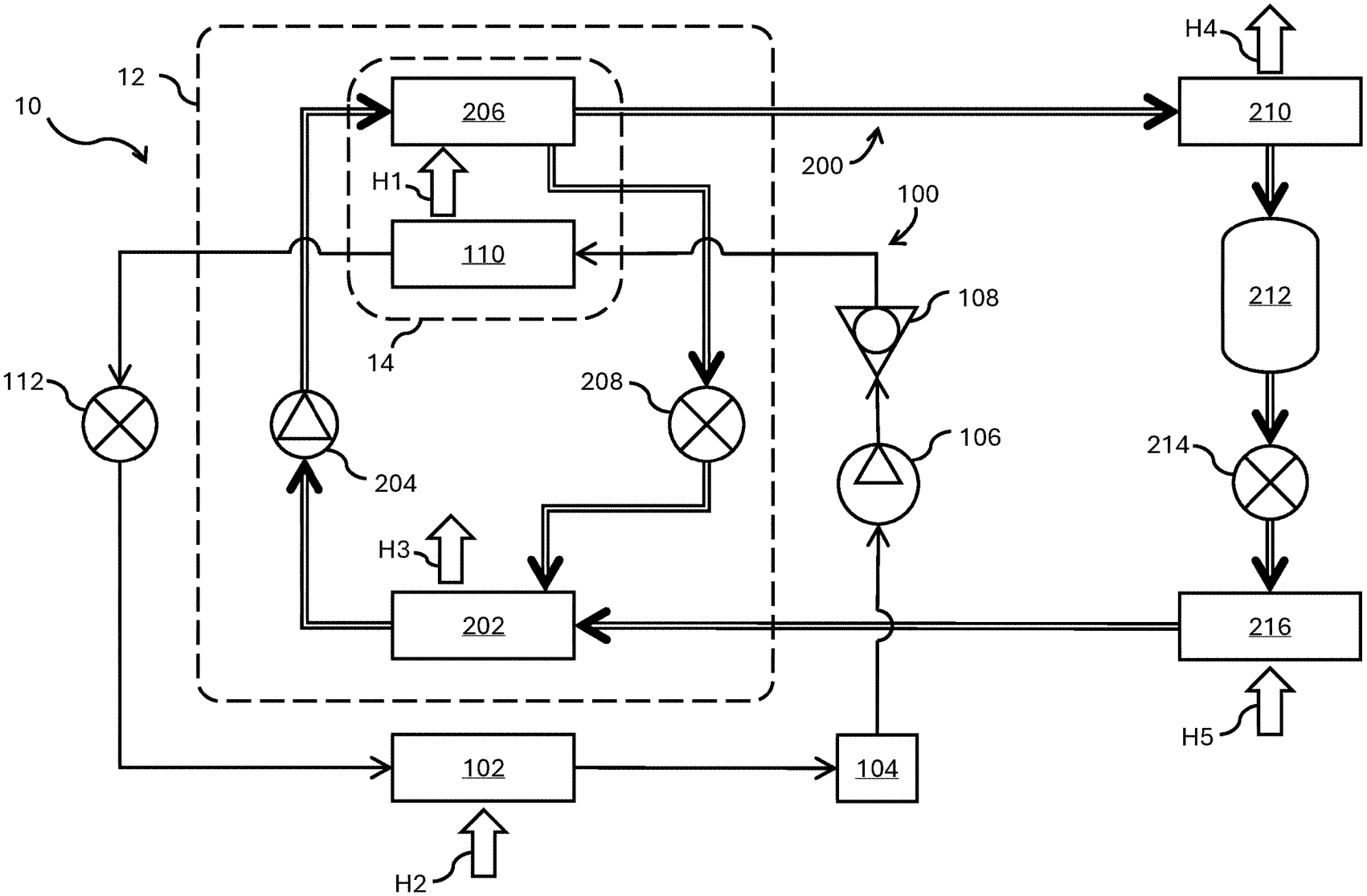
FIG. 1 is a simplified schematical depiction of an exemplary thermal system.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

A thermal system 10, which may also be referred to as a vapor compression and absorption refrigeration (VCAR) system, is depicted in FIGS. 1-7. The system 10 may be used in a variety of applications, including, but not limited to, heat pumps for cold climates, refrigeration systems 10 (e.g., supermarket refrigeration systems), air conditioning systems for hot climates, transport refrigeration systems, freezers, and cooling data centers and super-computers.

According to the disclosure, the thermal system 10 includes a vapor compression refrigeration (VCR) circuit 100 through which a first refrigerant is flowable, an absorption refrigeration (AR) circuit 200 through which a second refrigerant and an absorbent is flowable, a thermo-compressor 12, and a first heat exchanger unit 14. Optionally, the system 10 also includes a second heat exchanger unit 16 and/or a third heat exchanger unit 18. The thermo-compressor 12 includes the first heat exchanger unit 14 and, optionally, the second heat exchanger unit 16. During operation of the system 10, the VCR circuit 100 and the AR circuit 200 are operated simultaneously (i.e., the first refrigerant is flowing through the VCR circuit 100 at the same time as the second refrigerant and the absorbent are flowing through the AR circuit 200). The AR circuit 200 (e.g., the generator 206) absorbs and is at least partially powered by waste heat generated by the VCR circuit 100 (e.g., the heat rejection heat exchanger 110). As such, the AR circuit 200 utilizes waste heat of the VCR circuit 100 to provide cooling to one or more heat sources (e.g., via the heat absorption heat exchanger 102 and/or the heat absorption heat exchanger 216). Optionally, the thermo-compressor 12 of the AR circuit 200 may include a recuperation heat exchanger providing thermal contact between the refrigerant/absorbent solution exiting the generator and the refrigerant/absorbent solution leaving the pump. The VCR circuit may be configured to employ any known advanced modification of the refrigeration system architecture-multi-stage, recuperation, ejector based, etc. The AR circuit may be configured to employ any known advanced modification of the refrigeration system architecture-multi-stage, recuperation, ejector based, etc.

An exemplary method of operating the system 10 includes the steps and/or processes involved in operating the VCR circuit 100 and the AR circuit 200 (i.e., the first and second portions of the AR circuit 200) as described herein.

The vapor compression refrigeration (VCR) circuit 100 is a closed circuit that conducts the first refrigerant. The first refrigerant is a green refrigerant in some examples. The first refrigerant may be the same as or different than the second refrigerant of the AR circuit 200. Depending on its location within the VCR circuit 100, the first refrigerant may be present in a liquid-state, a vapor-state, and/or a two-phase state in which the first refrigerant is present in both the liquid-state and the vapor-state.

The VCR circuit 100 includes a heat absorption heat exchanger 102, a compressor 106, an optional check-valve 108, a heat rejection heat exchanger 110, an expansion valve 112, and, optionally, a suction accumulator 104. The suction accumulator 104 is configured to protect the compressor 106 and/or to provide refrigerant charge management if the VCR circuit 100 is a trans-critical circuit. Optionally, the VCR circuit 100 also includes an ejector configured to function as a booster compressor 106 and/or as an overfeeding device. The heat absorption heat exchanger 102 is disposed downstream of the expansion valve 112, and is disposed between and connected to the expansion valve 112 and the suction accumulator 104. The suction accumulator 104 is disposed downstream of the heat absorption heat exchanger 102, and is disposed between and connected to the heat absorption heat exchanger 102 and the compressor 106. The compressor 106 is disposed downstream of the suction accumulator 104, and is disposed between and connected to the suction accumulator 104 and the check-valve 108. The check-valve 108 is disposed downstream of the compressor 106, and is disposed between and connected to the compressor 106 and the heat rejection heat exchanger 110. The heat rejection heat exchanger 110 is disposed downstream of the check-valve 108, and is disposed between and connected to the check-valve 108 and the expansion valve 112. The expansion valve 112 is disposed downstream of the heat rejection heat exchanger 110, and is disposed between and connected to the heat rejection heat exchanger 110 and the heat absorption heat exchanger 102. As such, during operation, the first refrigerant flows sequentially through the heat absorption heat exchanger 102, the suction accumulator 104, the compressor 106, the check-valve 108, the heat rejection heat exchanger 110, and the expansion valve 112. The heat absorption heat exchanger 102 and the heat rejection heat exchanger 110 are part and/or components of the thermo-compressor 12.

The heat rejection heat exchanger 110 of the VCR circuit 100 and the generator 206 of the AR circuit 200 are integrated with one another and are components of the first heat exchanger unit 14. The heat rejection heat exchanger 110 and the generator 206 are integrated with one another within the first heat exchanger unit 14 such that heat emitted by the heat rejection heat exchanger 110 is transferred to and utilized by the generator 206 (e.g., as a thermal energy input), which cools the heat rejection heat exchanger 110. The generator 206 utilizes the waste heat of the heat rejection heat exchanger 110 that is naturally generated during operation of the system 10.

In examples (e.g., FIGS. 1, 4, 7), the heat absorption heat exchanger 102 of the VCR circuit 100 is not integrated with a component of the AR circuit 200, nor part of a heat exchanger unit. The heat absorption heat exchanger 102 absorbs heat H2 from one or more external heat sources (e.g., one or more environments, systems, and/or components) and, thus, cools the heat source(s). The absorber 202 emits heat H3 which is transferred to, absorbed by, and/or utilized by one or more other external heat sources (e.g., one or more environments, systems, and/or components) and, thus, heats these other heat source(s). Since the heat absorption heat exchanger 102 utilizes the waste heat H2 of one or more heat sources that, preferably, naturally emit heat (e.g., an external environment) and/or naturally generate heat during operation, the amount of power consumed by the system 10 during operation is reduced compared with conventional vapor compression refrigeration systems. The compressor 106 operates at higher SST than the evaporating temperature in the heat absorption heat exchanger 216 of the AR circuit 200, which means that the compressor power per kilogram (kg) of the pumped refrigerant is significantly reduced, and the compressor 106 pumping liquids consumes at least an order of magnitude less power than a conventional compressor pumping vapor.

In other examples (e.g., FIGS. 2, 5), the heat absorption heat exchanger 102 of the VCR circuit 100 and the absorber 202 of the AR circuit 200 are integrated with one another and are components of the second heat exchanger unit 16. The heat absorption heat exchanger 102 and the absorber 202 are integrated with one another within the second heat exchanger unit 16 such that heat H3 emitted by the absorber 202 is transferred to and utilized by the heat absorption heat exchanger 102 (e.g., as a thermal energy input), which also cools the absorber 202. The system 10 is configured in such a way that the heat absorption heat exchanger 102 of the VCR circuit 100 operates at higher evaporating temperature than that in the heat absorption heat exchanger 216 of the AR circuit 200. Therefore, the compressor 106 operates at higher SST than the evaporating temperature in the heat absorption heat exchanger 216 which means that the compressor power per kilogram (kg) of the pumped refrigerant is significantly reduced, and the compressor 106 pumping liquids consumes at least an order of magnitude less power than a conventional compressor pumping vapor. This results in an overall power reduction.

In further examples (e.g., FIGS. 3, 6), the heat absorption heat exchanger 102 of the VCR circuit 100 and the heat rejection heat exchanger 210 of the AR circuit 200 are integrated with one another and are components of the third heat exchanger unit 18. The heat absorption heat exchanger 102 and the heat rejection heat exchanger 210 are integrated with one another within the third heat exchanger unit 18 such that heat H4 emitted by the heat rejection heat exchanger 210 is transferred to and utilized by the heat absorption heat exchanger 102 (e.g., as a thermal energy input), which also cools the heat rejection heat exchanger 210. Moreover, since the heat absorption heat exchanger 102 utilizes the waste heat H4 of the heat rejection heat exchanger 210 that is naturally generated during operation of the system 10, the amount of power consumed by the system 10 during operation is reduced compared with conventional vapor compression refrigeration systems. The compressor 106 operates at higher SST than the evaporating temperature in the heat absorption heat exchanger 216, which means that the compressor power per kilogram (kg) of the pumped refrigerant is significantly reduced, and the compressor 106 pumping liquids consumes at least order of magnitude less power than a conventional compressor pumping vapor. In some examples, water, air, and/or another fluid (e.g., flowing within another, separate circuit) heats the heat absorption heat exchanger 102 and cools the absorber 202 and the heat rejection heat exchanger 210.

The absorption refrigeration (AR) circuit 200 is a closed circuit that conducts the second refrigerant and the absorbent. The second refrigerant is soluble with the absorbent. The second refrigerant is a green refrigerant in some examples. The second refrigerant may be the same as or different than the first refrigerant of the VCR circuit 100. Depending on its location within the AR circuit 200, the second refrigerant may be present in a liquid-state, a vapor-state, and/or a two-phase state in which the second refrigerant is present in both the liquid-state and the vapor-state. The absorbent is present in the AR circuit 200 in a liquid-state. The absorbent is an ionic liquid with no vapor pressure in some examples. The absorbent is configured to absorb the second refrigerant and form a refrigerant/absorbent solution. The refrigerant/absorbent solution is present in the AR circuit 200 in a liquid-state and includes different concentrations of the second refrigerant depending on its location within the AR circuit 200.

A first portion of the AR circuit 200 is part of and/or disposed within the thermo-compressor 12, and a second portion of the AR circuit 200 is not a part of and/or is disposed outside of the thermo-compressor 12. The absorbent and/or the refrigerant/absorbent solution is disposed in and generally confined to the first portion of the AR circuit 200. In other words, practically speaking, the absorbent and/or the refrigerant/absorbent solution flows exclusively through the first portion of the AR circuit 200 (i.e., generally does not enter, nor flow through the second portion of the AR circuit 200). Conversely, the second refrigerant is disposed in and flows through both the first and second portions of the AR circuit 200.

The first portion of the AR circuit 200 includes an absorber 202, a pump 204, a generator 206, and a throttling valve 208. The absorber 202 is disposed downstream of the throttling valve 208, and is disposed between and connected to the throttling valve 208 and the pump 204. The absorber 202 is also disposed downstream of the heat absorption heat exchanger 216 (e.g., FIGS. 1-6), the four-way valve 230 (e.g., FIGS. 4-6), and/or the turbine 250 (e.g., FIG. 7), and is disposed between and connected to the pump 204 and one of the heat absorption heat exchanger 216 (e.g., FIGS. 1-3), the four-way valve 230 (e.g., FIGS. 4-6), and the turbine 250 (e.g., FIG. 7). The pump 204 is disposed downstream of the absorber 202, and is disposed between and connected to the absorber 202 and the generator 206. The generator 206 is disposed downstream of the pump 204, and is disposed between and connected to the pump 204 and the throttling valve 208. The generator 206 is also disposed upstream of the heat rejection heat exchanger 210 (e.g., FIGS. 1-6), the four-way valve 230 (e.g., FIGS. 4-6), and/or the turbine 250 (e.g., FIG. 7), and is disposed between and connected to the pump 204 and one of the heat rejection heat exchanger 210 (e.g., FIGS. 1-3), the four-way valve 230 (e.g., FIGS. 4-6), and the turbine 250 (e.g., FIG. 7). The throttling valve 208 is disposed downstream of the generator 206, and is disposed between and connected to the generator 206 and the absorber 202. As such, during operation, at least a portion of the second refrigerant and/or the absorbent flow sequentially through the absorber 202, the pump 204, the generator 206, and the throttling valve 208. The first portion of the AR circuit 200, the absorber 202, the pump 204, the generator 206, and the throttling valve 208 are part and/or components of the thermo-compressor 12. The generator 206 of the AR circuit 200 and the heat rejection heat exchanger 110 of the VCR circuit 100 are integrated with one another and are components of the first heat exchanger unit 14. In examples (e.g., FIGS. 1, 3, 4, 6, 7), the absorber 202 of the AR circuit 200 is not integrated with a component of the VCR circuit 100, nor part of a heat exchanger unit. In other examples (e.g., FIGS. 2, 5), the absorber 202 of the AR circuit 200 and the heat absorption heat exchanger 102 of the VCR circuit 100 are integrated with one another and are components of the second heat exchanger unit 16.

Figure 3:
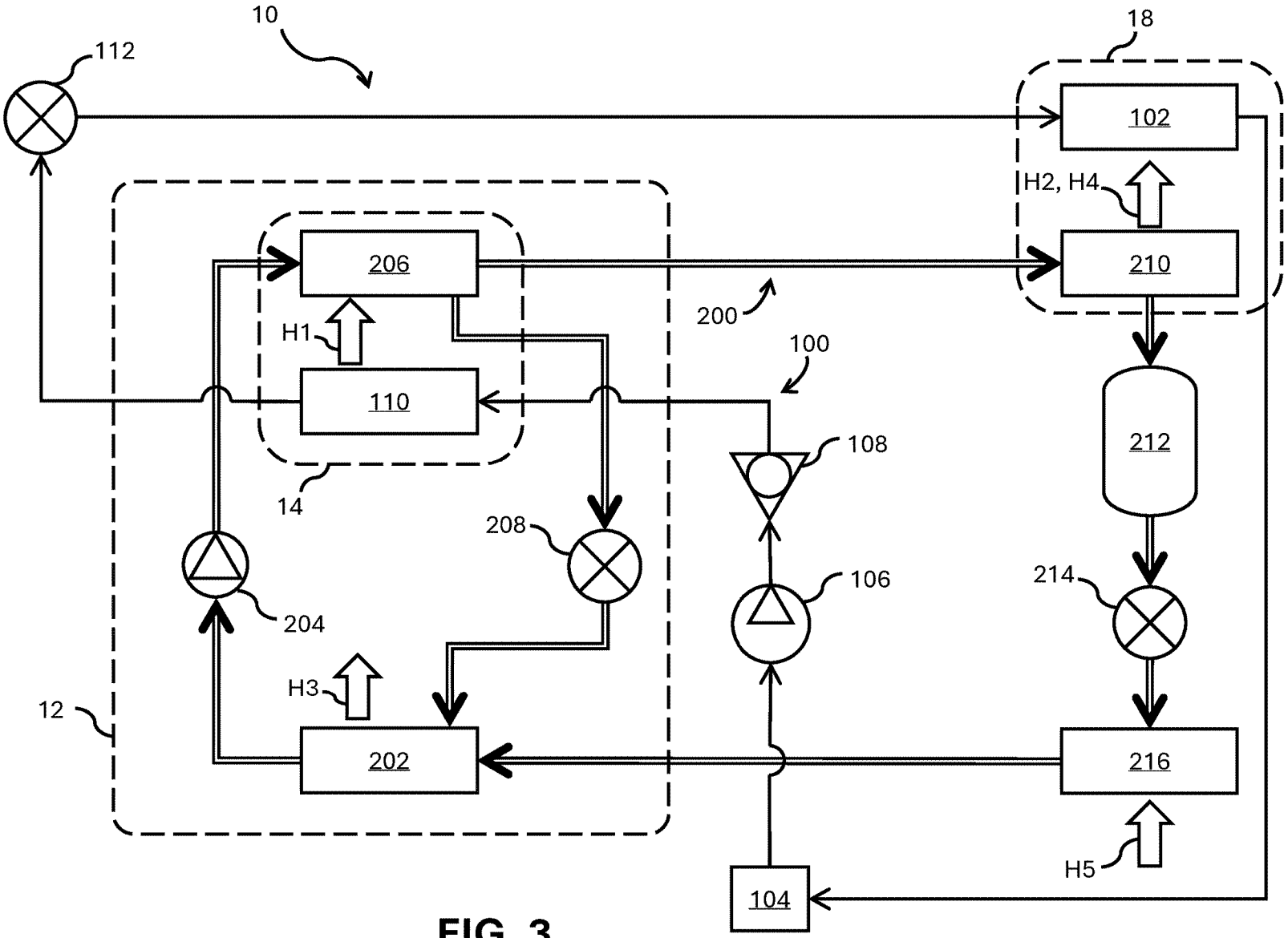
FIG. 3 is a simplified schematical depiction of an exemplary thermal system including a third heat exchanger unit.
Figure 4:
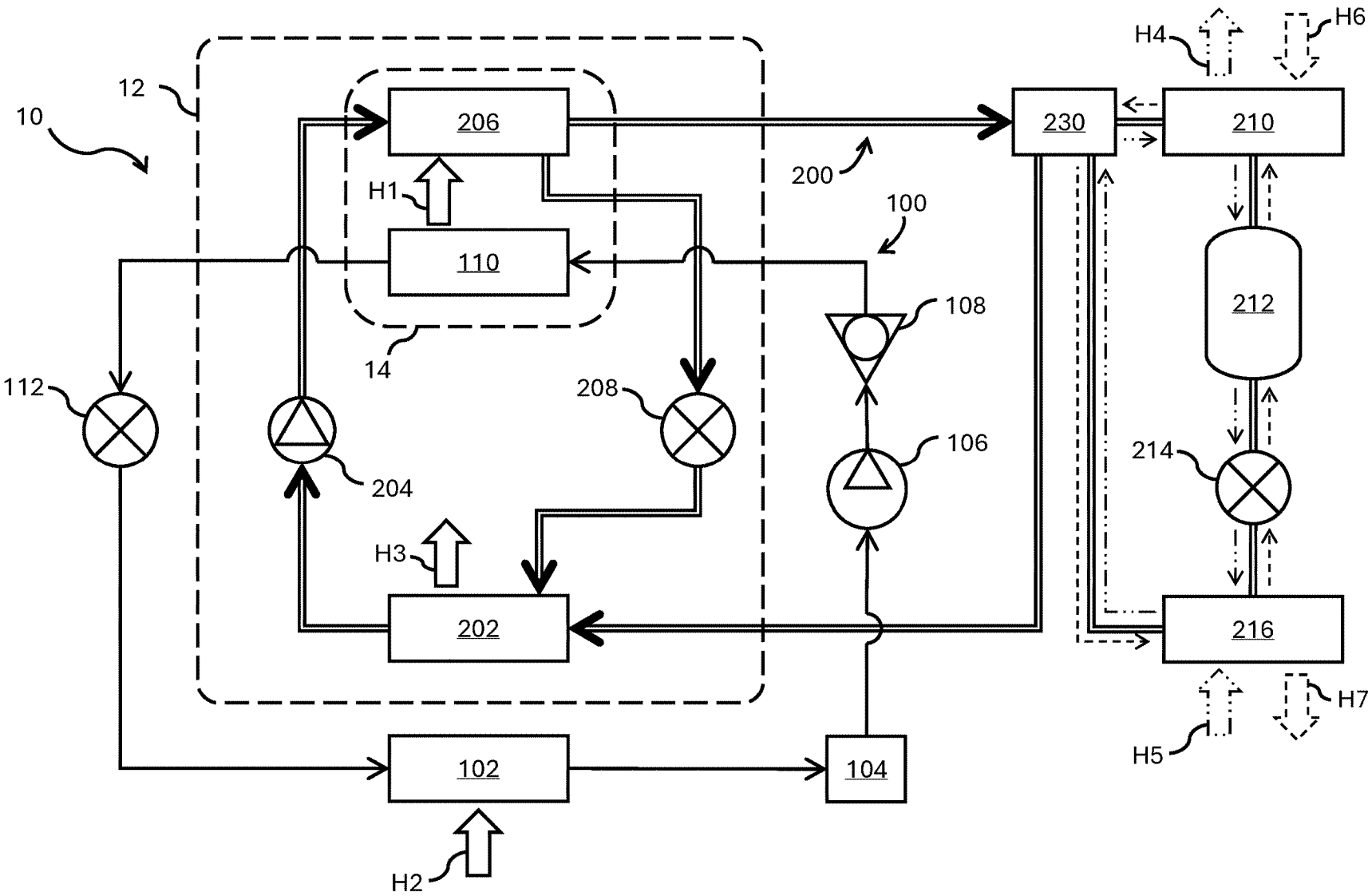
FIG. 4 is a simplified schematical depiction of the exemplary thermal system of FIG. 1 including a four-way valve.
Figure 5:
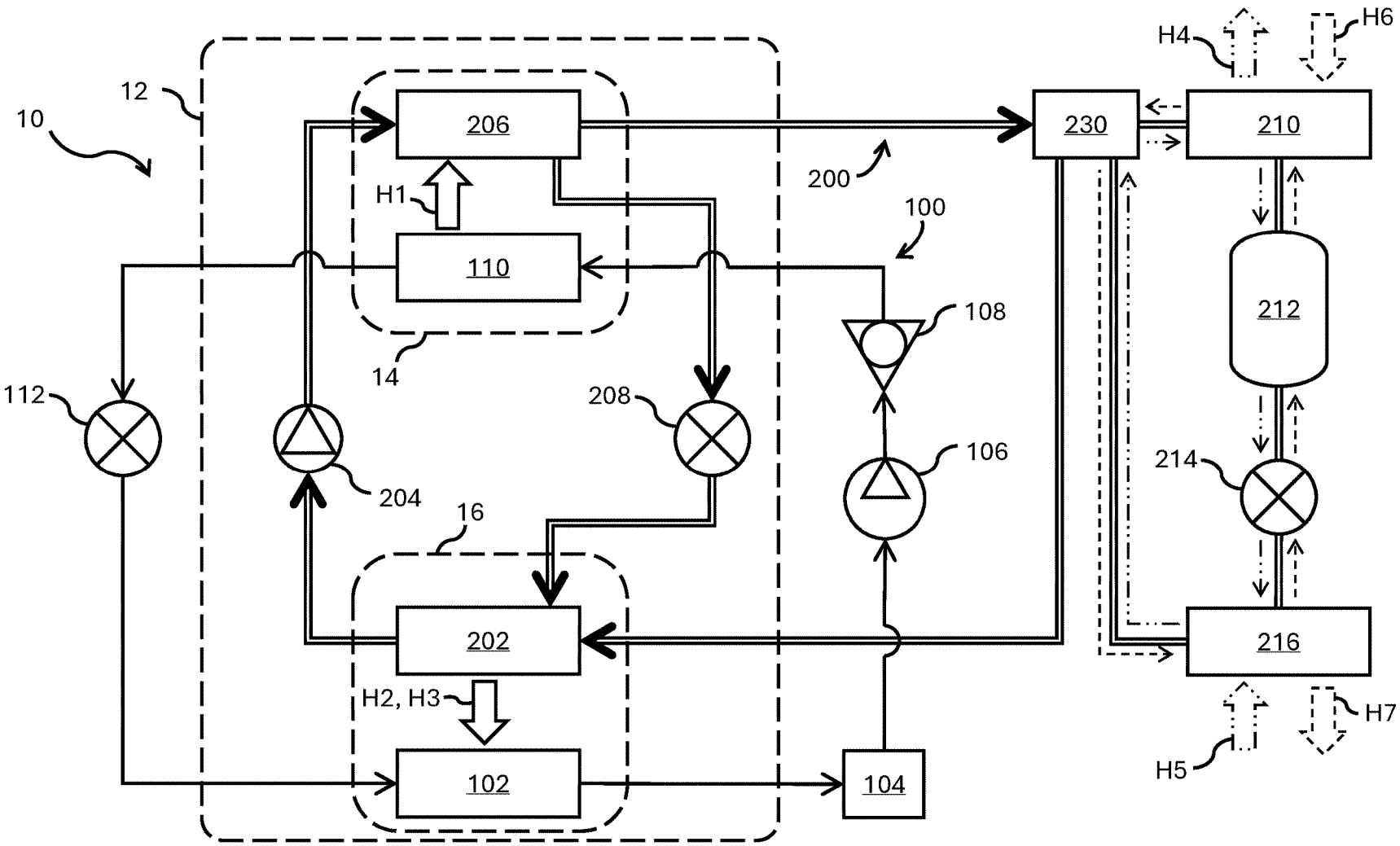
FIG. 5 is a simplified schematical depiction of the exemplary thermal system of FIG. 2 including a four-way valve.
Figure 6:
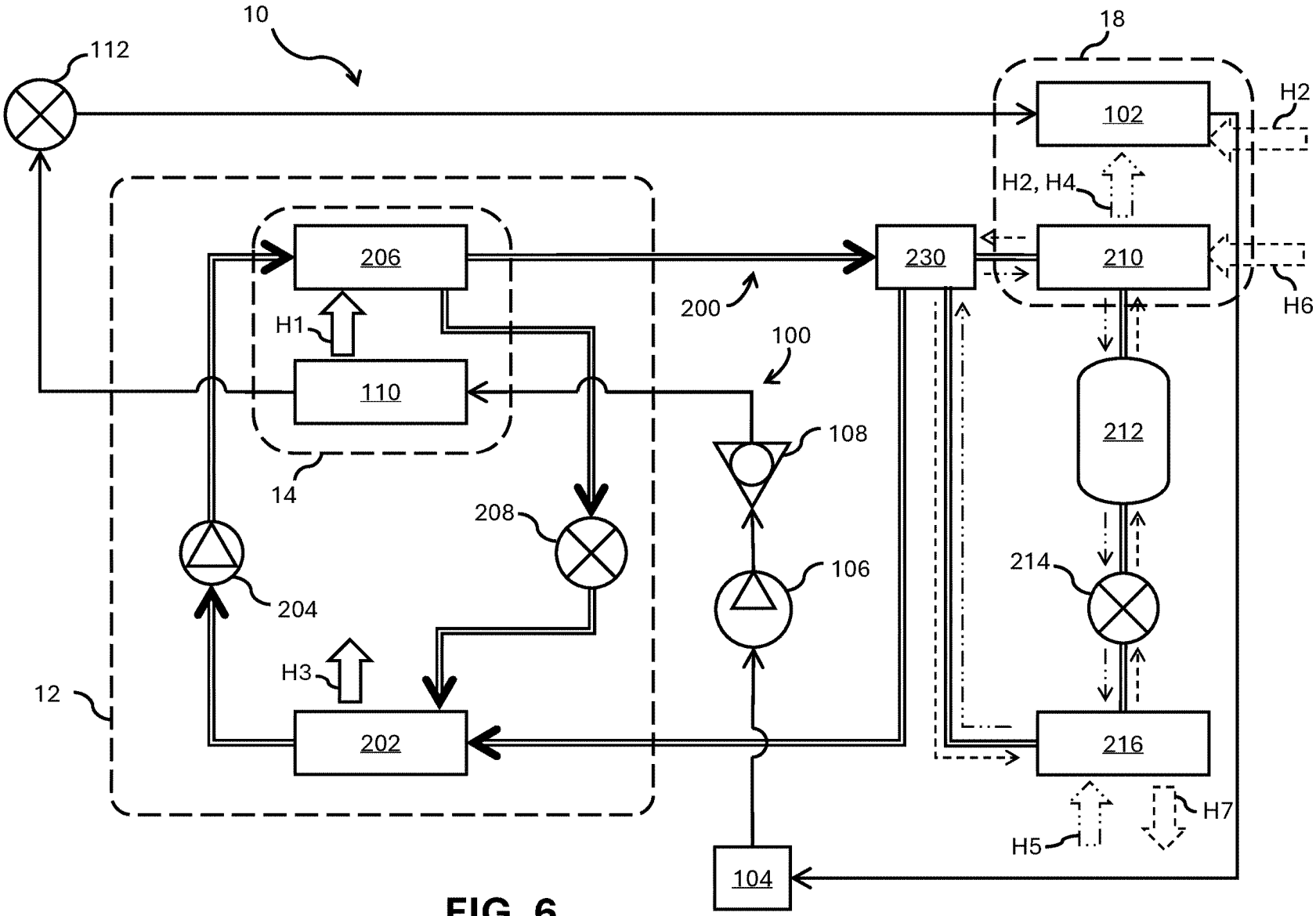
FIG. 6 is a simplified schematical depiction of the exemplary thermal system of FIG. 3 including a four-way valve.

In some examples (e.g., FIGS. 1-6), the second portion of the AR circuit 200 includes a heat rejection heat exchanger 210, a receiver 212, an expansion valve 214, a heat absorption heat exchanger 216, and, optionally, a four-way valve 230 (e.g., FIGS. 4-6). The heat rejection heat exchanger 210 is disposed downstream of the generator 206 (e.g., FIGS. 1-6) and/or the four-way valve 230 (e.g., FIGS. 4-6), and is disposed between and connected to the receiver 212 and one of the generator 206 (e.g., FIGS. 1-3) and the four-way valve 230 (e.g., FIGS. 4-6). The receiver 212 is disposed downstream of the heat rejection heat exchanger 210, and is disposed between and connected to the heat rejection heat exchanger 210 and the expansion valve 214. The expansion valve 214 is disposed downstream of the receiver 212, and is disposed between and connected to the receiver 212 and the heat absorption heat exchanger 216. The heat absorption heat exchanger 216 is disposed downstream of the expansion valve 214 and upstream of the absorber 202 (e.g., FIGS. 1-6) and/or the four-way valve 230 (e.g., FIGS. 4-6). The heat absorption heat exchanger 216 is disposed between and connected to the expansion valve 214 and one of the absorber 202 (e.g., FIGS. 1-3) and the four-way valve 230 (e.g., FIGS. 4-6). In other words, the thermo-compressor 12 is disposed between and connects the heat absorption heat exchanger 216 and the heat rejection heat exchanger 210. The downstream direction in the preceding description, with respect to FIGS. 4-6, corresponds to the flow direction when operating in the first mode. The second portion of the AR circuit 200, the heat rejection heat exchanger 210, the receiver 212, the expansion valve 214, and the heat absorption heat exchanger 216 are not part and/or components of the thermo-compressor 12, and are disposed outside of the thermo-compressor 12. In examples (e.g., FIGS. 1, 2, 4, 5, 7), the heat rejection heat exchanger 210 of the AR circuit 200 is not integrated with a component of the VCR circuit 100, nor part of a heat exchanger unit. In other examples (e.g., FIGS. 3, 6), the heat rejection heat exchanger 210 of the AR circuit 200 and the heat absorption heat exchanger 102 of the VCR circuit 100 are integrated with one another and are components of the third heat exchanger unit 18. For clarity, the heat absorption heat exchanger 102, heat rejection heat exchanger 110, and expansion valve 112 of the VCR circuit 100 may be referred to as the VCRC heat absorption heat exchanger 102, the VCRC heat rejection heat exchanger 110, and the VCRC expansion valve 112 respectively, and the heat absorption heat exchanger 216, heat rejection heat exchanger 210, and expansion valve 214 of the AR circuit 200 may be referred to as the ARC heat absorption heat exchanger 216, ARC heat rejection heat exchanger 210, and ARC expansion valve 214, respectively.

The receiver 212 is an optional component of the AR circuit 200. The receiver 212 is configured to store a redundant amount and/or extra liquid-phase second refrigerant to accommodate changes in the refrigerant charge demand of the system 10 (e.g., due to temperature changes in the environment in which the system 10 is operating, which also influence discharge and suction pressures and temperatures). Optionally, the AR circuit 200 also includes a solenoid valve disposed between and connected to the heat rejection heat exchanger 210 and the expansion valve 214. The solenoid valve is configured to stop and/or prevent the flow of the second refrigerant, and may be particularly beneficial when switching/turning off the expansion valve 214 alone is insufficient to stop and/or prevent the flow of the second refrigerant through the AR circuit 200. Additionally and/or alternatively, the AR circuit 200 further includes a recuperative heat exchanger providing thermal exchange between the fluid downstream of the pump 204 and the fluid upstream of the throttling valve 208.

With regard to FIGS. 1-7, the function and operation of the VCR circuit 100 during operation of the system 10 is as follows. Vapor-state first refrigerant at a first/low pressure and a first/low temperature flows out from the heat absorption heat exchanger 102 (i.e., out of the second heat exchanger unit 16 and out of the thermo-compressor 12 in FIGS. 2, 5; out of the third heat exchanger unit 18 in FIGS. 3, 6), through the suction accumulator 104, and to the compressor 106. The compressor 106 compresses the vapor-state first refrigerant, which increases the pressure and temperature of the vapor-state first refrigerant to a second/high pressure and a second/high temperature. The vapor-state first refrigerant at the second/high pressure and the second/high temperature then flows from the compressor 106, through the check-valve 108, and to the heat rejection heat exchanger 110 (i.e., into the thermo-compressor 12 and into the first heat exchanger unit 14). The heat rejection heat exchanger 110 condenses the vapor-state first refrigerant into a liquid-state at the second/high pressure and the first/low temperature. As a result, heat H1 (e.g., heat of condensation) is generated and emitted from the heat rejection heat exchanger 110. The heat H1 emitted by the heat rejection heat exchanger 110 is transferred to and utilized by the generator 206 of the AR circuit 200. The liquid-state first refrigerant flows from the heat rejection heat exchanger 110 (i.e., out from the first heat exchanger unit 14 and the thermo-compressor 12) to the expansion valve 112, where it is expanded into the two-phase state including both the liquid-state and the vapor-state. The expansion valve 112 also decreases the pressure of the first refrigerant such that the two-phase state first refrigerant is at the first/low pressure and the first/low temperature. The two-phase state first refrigerant then flows from the expansion valve 112 to the heat absorption heat exchanger 102 (i.e., into the thermo-compressor 12 and into the first heat exchanger unit 14 in FIGS. 2, 5; into the third heat exchanger unit 18 in FIGS. 3, 6). The two-phase state first refrigerant receives an input of heat H2 within the heat absorption heat exchanger 102, which evaporates the liquid-state first refrigerant present in the two-phase state first refrigerant such that substantially only vapor-state first refrigerant remains. The input of heat H2 is provided at least partially by at least one first heat source. Receiving the input of heat H2 includes the first refrigerant absorbing heat from the first heat source, which cools the first heat source (i.e., the heat absorption heat exchanger 102 cools the first heat source). In examples, the first heat source may be the surrounding environment and/or an unrelated system or component (e.g., FIGS. 1, 4, 7), the absorber 202 (e.g., FIGS. 2, 5 in which the input of heat H2 is the heat H3 emitted by the absorber 202), and/or the ARC heat rejection heat exchanger 210 (e.g., FIGS. 3, 6 in which the input of heat H2 is the heat H4 emitted by the ARC heat rejection heat exchanger 210). The vapor-state first refrigerant at the first/low pressure and the first/low temperature then flows out from the heat absorption heat exchanger 102 (i.e., out of the second heat exchanger unit 16 and out of the thermo-compressor 12 in FIGS. 2, 5; out of the third heat exchanger unit 18 in FIGS. 3, 6), through the suction accumulator 104, and to the compressor 106 at which point the above-described process repeats.

With regard to FIGS. 1-7, the function and operation of the first portion of the AR circuit 200 during operation of the system 10 is as follows. Vapor-state second refrigerant at a third/low pressure and a third/low temperature flows into the absorber 202 (i.e., into the thermo-compressor 12; also into the second heat exchanger unit 16 in FIGS. 2, 5) from the second portion of the AR circuit 200, such as from the ARC heat absorption heat exchanger 216 (e.g., FIGS. 1-3), the four-way valve 230 (e.g., FIGS. 4-6), or the turbine 250 (e.g., FIG. 7). The vapor-state second refrigerant that enters the absorber 202 is absorbed by the liquid-state refrigerant/absorbent solution that is present in the absorber 202. By absorbing the vapor-state second refrigerant, (i) a concentration of second refrigerant present in the liquid-state refrigerant/absorbent solution is increased to a first/high concentration and (ii) heat H3 (e.g., heat of absorption) is generated and emitted from the absorber 202. The heat H3 emitted by the absorber 202 is absorbed by, transferred to, and/or utilized by the VCRC heat absorption heat exchanger 102 (e.g., FIGS. 2, 5) and/or the surrounding environment of the thermo-compressor 12 or an unrelated system or component (e.g., FIGS. 1, 3, 4, 6, 7). The liquid-state refrigerant/absorbent solution with the first/high concentration, which is at a fourth temperature and the third/low pressure, is then pumped from the absorber 202 (i.e., from the second heat exchanger unit 16 in FIGS. 2, 5) to the generator 206 (i.e., the first heat exchanger unit 14) via the pump 204. The pump 204 increases the pressure of the liquid-state refrigerant/absorbent solution from the third/low pressure to a fourth/high pressure. The liquid-state refrigerant/absorbent solution receives an input of heat H1 within the generator 206, which evaporates at least some of the second refrigerant present in the liquid-state refrigerant/absorbent solution. As a result, vapor-state second refrigerant is generated/produced and the refrigerant concentration of the liquid-state refrigerant/absorbent solution is decreased from the first/high concentration to a second/low concentration. The input of heat H1 is provided at least partially by the VCRC heat rejection heat exchanger 110 (e.g., the input of heat H1 is the heat H1 emitted by the VCRC heat rejection heat exchanger 110) and, thus, the generator 206 cools the VCRC heat rejection heat exchanger 110. In some examples, the input of heat H1 is achieved via thermal contact with a heat source (e.g., the generator 206) that is at least 80°-100° C. The generator 206 (i.e., the first heat exchanger unit 14 and/or the thermo-compressor 12) then outputs the newly generated vapor-state second refrigerant, which is at a fifth/high temperature and the fourth/high pressure, to the second portion of the AR circuit 200, such as to the ARC heat rejection heat exchanger 210 (e.g., FIGS. 1-3), the four-way valve 230 (e.g., FIGS. 4-6), or the turbine 250 (e.g., FIG. 7). Meanwhile, the liquid-state refrigerant/absorbent solution with the second/low concentration flows from the generator 206 (i.e., out from the first heat exchanger unit 14) to the absorber 202 (i.e., into the second heat exchanger unit 16 in FIGS. 2, 5) via the throttling valve 208. The liquid-state refrigerant/absorbent solution within the absorber 202 then absorbs the vapor-state second refrigerant entering the absorber 202 (i.e., the thermo-compressor 12; also, the second heat exchanger unit 16 in FIGS. 2, 5) from the second portion of the AR circuit 200 and the above-described process repeats.

With regard to FIGS. 1-3, the function and operation of the second portion of the AR circuit 200 during operation of the system 10 is as follows. Vapor-state second refrigerant at the fifth/high temperature and the fourth/high pressure flows into the heat rejection heat exchanger 210 from the first portion of the AR circuit 200 (i.e., from the generator 206 of the first heat exchanger unit 14 of the thermo-compressor 12). The heat rejection heat exchanger 210 condenses the vapor-state second refrigerant into a liquid-state at the fourth/high pressure and the third/low temperature. As a result, heat H4 (e.g., heat of condensation) is generated and emitted from the heat rejection heat exchanger 210. The heat H4 emitted by the heat rejection heat exchanger 210 is absorbed by, transferred to, and/or utilized by the surrounding environment and/or an unrelated system or component (e.g., FIGS. 1, 2) and/or the VCRC heat absorption heat exchanger 102 (e.g., FIG. 3). The liquid-state second refrigerant flows out from the heat rejection heat exchanger 210, through the receiver 212, and to the expansion valve 214, where it is expanded into a two-phase state including both the liquid-state and the vapor-state. The expansion valve 214 also decreases the pressure of the second refrigerant such that the two-phase state second refrigerant is at the third/low pressure and the third/low temperature. The two-phase state second refrigerant then flows from the expansion valve 214 to the heat absorption heat exchanger 216. The two-phase state second refrigerant receives an input of heat H5 within the heat absorption heat exchanger 216, which evaporates the liquid-state second refrigerant present in the two-phase state second refrigerant such that substantially only vapor-state second refrigerant remains. The input of heat H5 (e.g., a low-grade waste heat) is provided at least partially by at least one second heat source, which in at least some examples has and/or is operating at a higher temperature than the VCRC heat absorption heat exchanger 102 and/or the first heat source. Receiving the input of heat H5 includes the second refrigerant absorbing heat from the second heat source, which cools the second heat source (i.e., the heat absorption heat exchanger 216 cools the second heat source). In examples, the second heat source may be the surrounding environment and/or an unrelated system or component (e.g., FIGS. 1-3). The vapor-state second refrigerant at the third/low pressure and the third/low temperature then flows out from the heat absorption heat exchanger 216 to the absorber 202 of the first portion of the AR circuit 200 (i.e., into the thermo-compressor 12; also into the second heat exchanger unit 16 in FIGS. 2, 5) and through the first portion of the AR circuit 200 (i.e., the thermo-compressor 12) as previously described. The vapor-state second refrigerant then flows out from the generator 206 of the first portion of the AR circuit 200 (i.e., out from the first heat exchanger unit 14 and the thermo-compressor 12) to the heat rejection heat exchanger 210 at which point the above-described process repeats.

In at least some examples, the ARC expansion valve 214, or the optional solenoid valve, is closed when the compressor 106 and pump 204 are on/operating. Additionally, a pressure switch shuts down/off the compressor 106 and the pump 204 when a pump suction side pressure reaches a threshold value.

The first refrigerant within the VCR circuit 100 is generally at one of two pressure levels during operation—a first pressure or a second pressure. The first pressure is lower than the second pressure. The fluid within the AR circuit 200 (i.e., second refrigerant, absorbent, and/or refrigerant/absorbent solution) is also generally at one of two pressure levels during operation—a third pressure or a fourth pressure. The third pressure is lower than the fourth pressure. The first/low pressure of the first refrigerant is higher than the third/low pressure of the fluid within the AR circuit 200.

The first refrigerant within the VCR circuit 100 is generally at one of two temperatures during operation—a first temperature or a second temperature. The first temperature is lower than the second temperature. The fluid within the AR circuit 200 (i.e., second refrigerant, absorbent, and/or refrigerant/absorbent solution) is generally at one of three temperatures during operation-a third temperature, a fourth temperature, or a fifth temperature. The third temperature is lower than the fifth temperature. The fourth temperature is an intermediate temperature that is greater than the third temperature and lower than the fifth temperature. However, the fourth temperature may alternatively be equal to or lower than the third temperature in other examples. The first/low temperature of the first refrigerant is higher than the third/low temperature of the fluid within the AR circuit 200. The first/low temperature of the first refrigerant is also generally aligned with and/or slightly lower than the fourth/intermediate temperature of the fluid within the AR circuit 200. The second/high temperature of the first refrigerant is generally aligned with and/or slightly higher than the fifth/high temperature of the fluid within the AR circuit 200.

Figure 2:
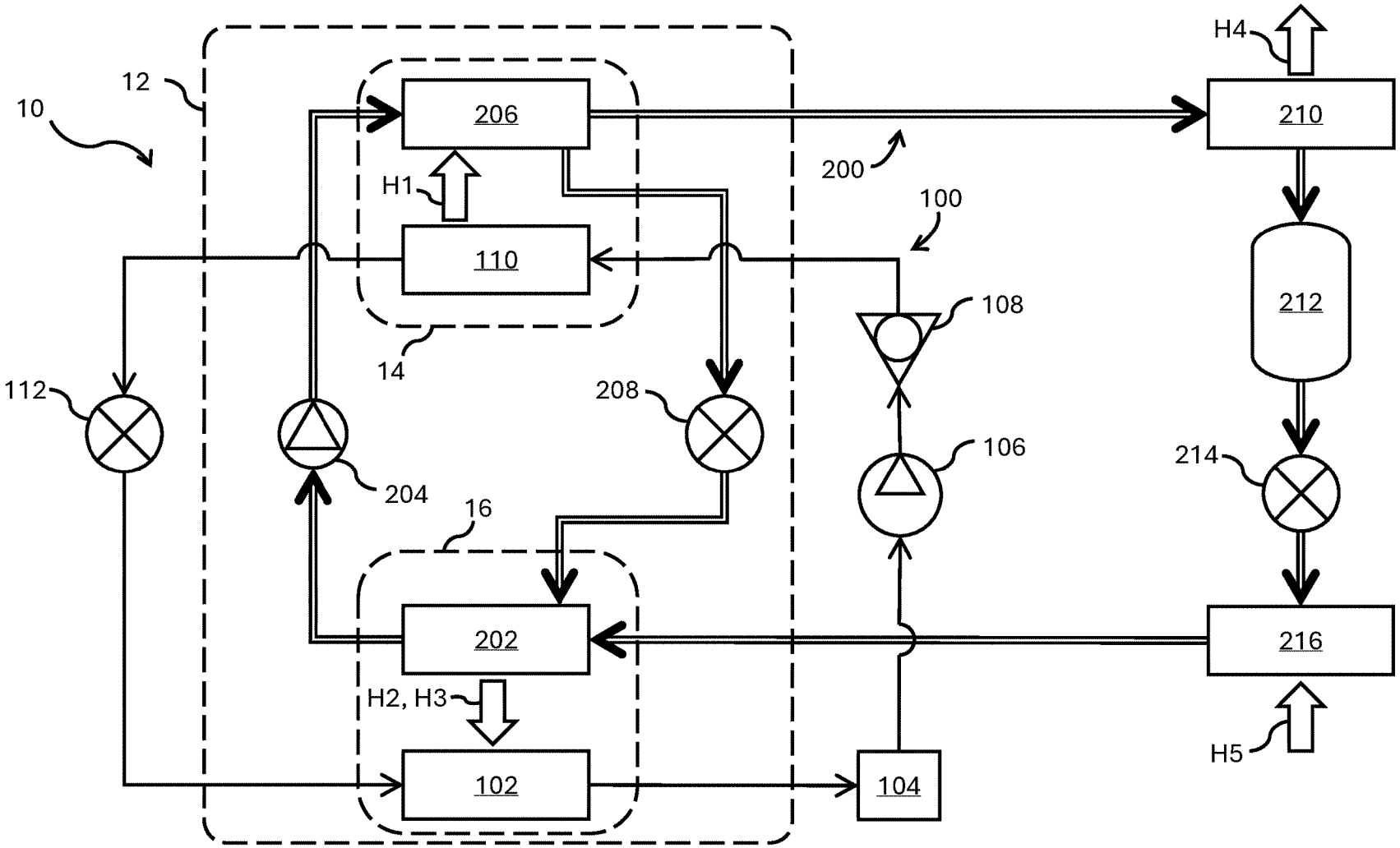
FIG. 2 is a simplified schematical depiction of an exemplary thermal system including a second heat exchanger unit.

The illustrative examples of system 10 depicted in FIGS. 4-6 correspond to those shown in FIGS. 1-3, respectively, except that the second portion of the AR circuit 200 in the examples of FIGS. 4-6 also include a four-way valve 230. The four-way valve 230 is disposed between and connects the thermo-compressor 12 (i.e., the generator 206 and the absorber 202), the heat rejection heat exchanger 210, and the heat absorption heat exchanger 216. The four-way valve 230 includes (i) an inlet connected to the generator 206, (ii) an outlet connected to the absorber 202, (iii) a first port connected to the heat rejection heat exchanger 210, and (iv) a second port connected to the heat absorption heat exchanger 216. The four-way valve 230 is configured to switch the system 10 and/or the second portion of the AR circuit 200 to a first mode (e.g., a first operating mode) and a second mode (e.g., a second operating mode).

When in the first mode, the four-way valve 230 (*i*) connects the inlet to the first port such that the second refrigerant flows from the generator 206 to the heat rejection heat exchanger 210 and (ii) connects the second port to the outlet such that the second refrigerant flows from the heat absorption heat exchanger 216 to the absorber 202. As such, when operating in the first mode, the second refrigerant from the generator 206 flows into the four-way valve 230 via the inlet, flows out through the first port of the four-way valve 230 to the heat rejection heat exchanger 210, flows sequentially through the heat rejection heat exchanger 210, receiver 212, expansion valve 214, and heat absorption heat exchanger 216, flows from the heat absorption heat exchanger 216 back into the four-way valve 230 via the second port, and flows out from the outlet of the four-way valve 230 to the absorber 202 as illustrated with the dash-dot-dot-dash arrows in FIGS. 4-6. The heat rejection heat exchanger 210 is operated as a heat rejection heat exchanger (e.g., a condenser) and the heat absorption heat exchanger 216 is operated as a heat absorption heat exchanger (e.g., an evaporator) in the first mode and, as such, the heat rejection heat exchanger 210 emits heat H4 (i.e., provides heating) and the heat absorption heat exchanger 216 absorbs heat H5 (i.e., provides cooling).

When in the second mode, the four-way valve 230 (*i*) connects the inlet to the second port such that the second refrigerant flows from the generator 206 to the heat absorption heat exchanger 216 and (ii) connects the first port to the outlet such that the second refrigerant flows from the heat rejection heat exchanger 210 to the absorber 202. As such, when operating in the second mode, the second refrigerant from the generator 206 flows into the four-way valve 230 via the inlet, flows out through the second port of the four-way valve 230 to the heat absorption heat exchanger 216, flows sequentially through the heat absorption heat exchanger 216, expansion valve 214, receiver 212, and heat rejection heat exchanger 210, flows from the heat rejection heat exchanger 210 back into the four-way valve 230 via the first port, and flows out from the outlet of the four-way valve 230 to the absorber 202 as illustrated with the dashed arrows in FIGS. 4-6. The heat rejection heat exchanger 210 is operated as an heat absorption heat exchanger (e.g., an evaporator) and the heat absorption heat exchanger 216 is operated as a heat rejection heat exchanger (e.g., a condenser) in the second mode and, as such, the heat rejection heat exchanger 210 absorbs heat H6 (i.e., provides cooling) and the heat absorption heat exchanger 216 emits heat H7 (i.e., provides heating).

With regard to FIGS. 2, 4, and 6, in at least some examples, the system 10 is a heat pump 204 in which the heat rejection heat exchanger 210 is configured as and/or part of an outdoor unit that is disposed at least partially in and/or fluidically connected to an external environment, and the heat absorption heat exchanger 216 is configured as and/or part of an indoor unit that is disposed at least partially in and/or fluidically connected to an indoor environment. Alternatively, the heat rejection heat exchanger 210 may be configured as and/or part of the indoor unit and the heat absorption heat exchanger 216 may be configured as and/or part of the outdoor unit. When operating in the first mode, the indoor unit/heat absorption heat exchanger 216 absorbs heat H5 from the air within the indoor environment, which cools the air within the indoor environment, and the outdoor unit/heat rejection heat exchanger 210 emits heat H4 to the external environment (e.g., FIGS. 2 and 4) and/or to another indoor environment, component, system, and/or object (e.g., to the VCRC heat absorption heat exchanger 102 in FIG. 6), which heats the environment, component, system, and/or object. When operating in the second mode, the indoor unit/heat absorption heat exchanger 216 emits heat H7 into the indoor environment, which heats the air within the indoor environment, and the outdoor unit/heat rejection heat exchanger 210 absorbs heat H6 from the external environment (e.g., FIGS. 2, 4, and 6) and/or from another indoor environment, component, system, and/or object (e.g., potentially some amount of heat from the VCRC heat absorption heat exchanger 102 in FIG. 6), which cools the environment, component, system, and/or object. The first mode and the second mode may therefore be considered and/or referred to as a cooling mode and a heating mode, respectively. The heat pump 204 may generally be operated in the first/cooling mode during summertime and in the second/heating mode during the wintertime. The heat pump 204 could conceivably be utilized to heat and/or cool things other than the air within an indoor environment, such as a fluid (e.g., water) or a heat generating component (e.g., a computer server).

The heat pump is configured to operate at the highest suction and discharge temperatures provided that the discharge pressure covers hot day conditions in summertime. The heat pump can heat during wintertime using the indoor room unit operating as a condenser and cool electronics using the heat absorption heat exchanger 102. Compressor-based air conditioners are rated to operate in ambient temperatures up to 131° F./55° C. Hot day conditions are associated with ambient temperatures of 131° F. and higher. The discharge pressures and saturated discharge temperatures established at the hot day conditions, are high. Most standard heat pumps will function at 100% efficiency until the outside temperature reaches about 40° F. However, when the temperature dips below this, most heat pumps are not able to maintain 100% efficiency. Standard heat pumps also become much less effective at temperatures of 20° F. to 30° F. The suction pressures and saturated suction temperatures established at those cold conditions are low. In contrast, the disclosed heat pump efficiently operates in cold climates due to the configuration of the VCR circuit 100 and the AR circuit 200.

With regard to FIGS. 4-6, the function and operation of the second portion of the AR circuit 200 in the first/cooling mode, which is depicted with the dash-dot-dot-dash arrows in FIGS. 4-6, is as follows. Vapor-state second refrigerant at the fifth/high temperature and the fourth/high pressure flows into the four-way valve 230 (e.g., via the inlet of the four-way valve 230) from the first portion of the AR circuit 200 (e.g., the generator 206, first heat exchanger unit 14, and/or thermo-compressor 12). The four-way valve 230 directs the vapor-state second refrigerant out through the first port to the heat rejection heat exchanger 210. The second refrigerant flows through the heat rejection heat exchanger 210, receiver 212, expansion valve 214, and heat absorption heat exchanger 216 as previously described with respect to FIGS. 1-3. The vapor-state second refrigerant at the third/low temperature and the third/low pressure exit the heat absorption heat exchanger 216, flow into the four-way valve 230 via the second port, flows out of the four-way valve 230 through the outlet, and flows into the absorber 202 of the first portion of the AR circuit 200. The second refrigerant flows through the first portion of the AR circuit 200 (i.e., the thermo-compressor 12) as previously described, and flows out from the generator 206 (i.e., the thermo-compressor 12) to the four-way valve 230 at which point the above-described process repeats.

With regard to FIGS. 4-6, the function and operation of the second portion of the AR circuit 200 in the second/heating mode, which is depicted with the dashed arrows in FIGS. 4-6, is as follows. Vapor-state second refrigerant at the fifth/high temperature and the fourth/high pressure flows into the four-way valve 230 (e.g., via the inlet of the four-way valve 230) from the first portion of the AR circuit 200 (e.g., the generator 206, first heat exchanger unit 14, and/or thermo-compressor 12). The four-way valve 230 directs the vapor-state second refrigerant out through the second port to the heat absorption heat exchanger 216. The heat absorption heat exchanger 216, which is operating as a heat rejection heat exchanger (e.g., a condenser), condenses the vapor-state second refrigerant into a liquid-state at the fourth/high pressure and the third/low temperature. As a result, heat H7 (e.g., heat of condensation) is generated and emitted from the heat absorption heat exchanger 216. The heat H7 emitted by the heat absorption heat exchanger 216 is absorbed by, transferred to, and/or utilized by the surrounding environment and/or an unrelated system or component. The liquid-state second refrigerant flows out from the heat absorption heat exchanger 216 and to the expansion valve 214, where it is expanded into a two-phase state including both the liquid-state and the vapor-state. The expansion valve 214 also decreases the pressure of the second refrigerant such that the two-phase state second refrigerant is at the third/low pressure and the third/low temperature. The two-phase state second refrigerant then flows out from the expansion valve 214, through the receiver 212, and to the heat rejection heat exchanger 210. Within the heat rejection heat exchanger 210, which is operating as a heat absorption heat exchanger (e.g., an evaporator), the two-phase state second refrigerant receives an input of heat H6, which evaporates the liquid-state second refrigerant present in the two-phase state second refrigerant such that substantially only vapor-state second refrigerant remains. The input of heat H6 is provided at least partially by at least one third heat source. Receiving the input of heat H6 includes the second refrigerant absorbing heat from the third heat source, which cools the third heat source (i.e., the heat rejection heat exchanger 210 cools the third heat source). In examples, the third heat source may be the surrounding environment and/or an unrelated system or component. The vapor-state second refrigerant at the third/low temperature and the third/low pressure exits the heat rejection heat exchanger 210, flows into the four-way valve 230 via the first port, flows out of the four-way valve 230 through the outlet, and flows into the absorber 202 of the first portion of the AR circuit 200 (i.e., the thermo-compressor 12). The second refrigerant flows through the first portion of the AR circuit 200 (i.e., the thermo-compressor 12) as previously described, and flows out from the generator 206 (i.e., the thermo-compressor 12) to the four-way valve 230 at which point the above-described process repeats.

During operation, the evaporating temperature in the AR heat absorption heat exchanger 216 satisfies requirements for cooling or heating and the VCR circuit 100 operates at a saturated suction temperature (SST) which is higher than the evaporating temperature of the AR heat absorption heat exchanger 216. This is favorable for the COP of the VCR circuit 100 and for the overall COP of the system 10. Balance between the VCR circuit 100 and the AR circuit 200 is achieved at certain compressor-to-pump mass flow rate ratios. In the first/cooling mode, a controller (e.g., ECU) of the system 10 controls the AR heat absorption heat exchanger 216 cooling capacity by sensing, for example, the temperature of the second heat source and adjusting the pump flow rate using a variable speed approach or an ON/OFF cycling approach. The controller also controls heat input to the generator 206 by sensing, for example, temperature in the generator 206 and adjusting the compression flow rate using a variable speed approach or an ON/OFF cycling approach. When compressor speed changes, the SST of the VCR circuit 100 is adjusted. In the second/heating mode, the controller controls the heating capacity of the AR heat absorption heat exchanger 216 (operating as a heat rejection heat exchanger and/or a condenser) by sensing, for example, the temperature of the second heat source and adjusting the pump flow rate using a variable speed approach or an ON/OFF cycling approach. The system 10 is configured to maintain sufficiently high discharge pressure and suction pressure or SST to cover the entire operating envelope.

Figure 7:
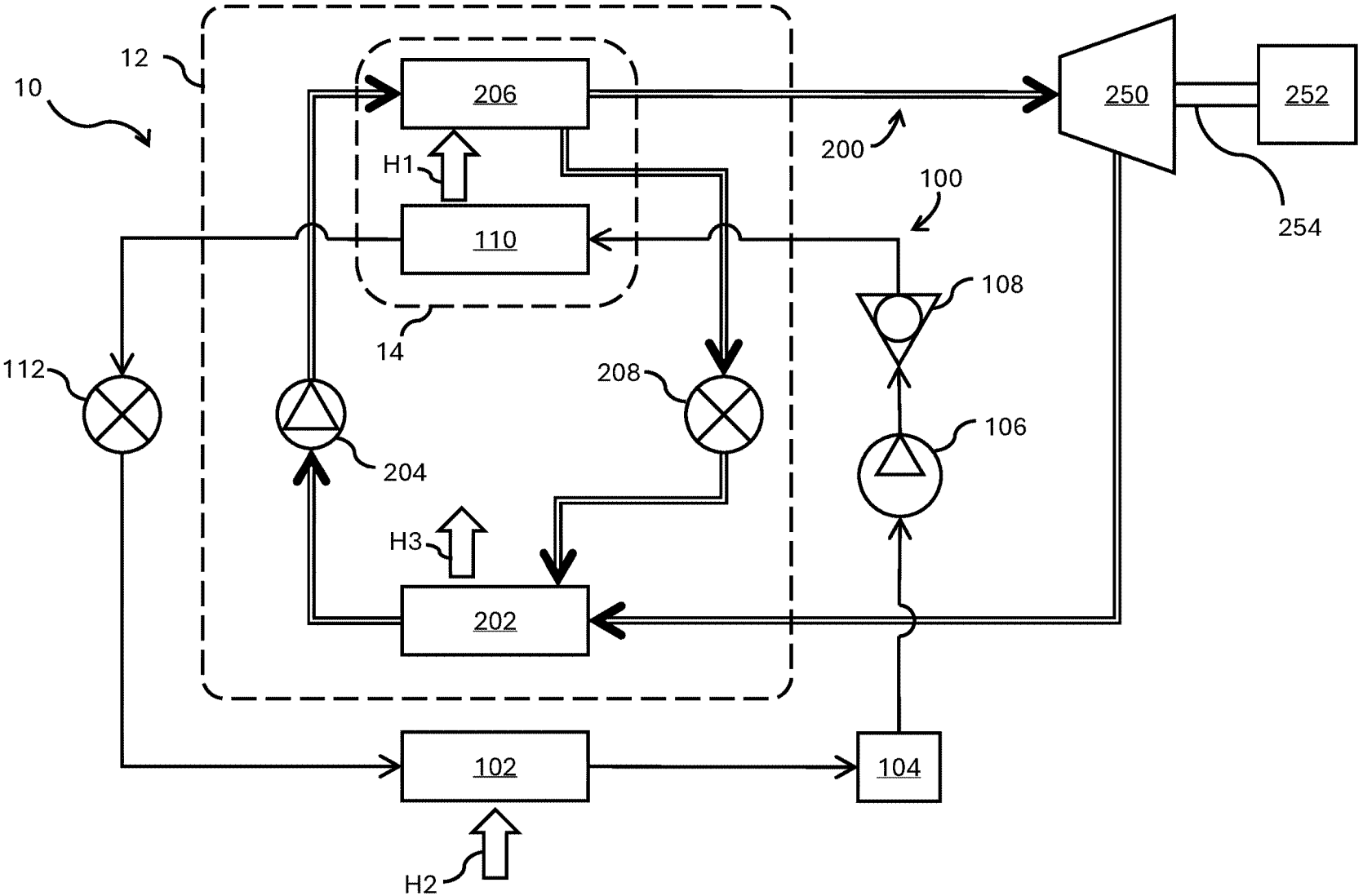
FIG. 7 is a simplified schematical depiction of an exemplary thermal system including a turbine and a power generator.

The illustrative example of FIG. 7 corresponds to the system 10 shown in FIG. 1 except that the second portion of the AR circuit 200 in the system 10 of FIG. 7 includes at least one turbine 250 for generating electrical or mechanical power rather than the heat rejection heat exchanger 210, receiver 212, expansion valve 214, and heat absorption heat exchanger 216. The turbine 250 is connected to a power generator 252 via a drive shaft 254. In some examples, the compressor 106, the pump 204, the turbine 250, and the power generator 252 are each operatively connected to a common shaft (e.g., a common drive shaft).

The pressure ratio across the turbine 250 is higher than the pressure ratio in the compressor 106. The net power that is generated by the system 10 is the amount of power generated by the turbine 250 minus the amount of power consumed by the compressor 106 and the pump 204. A high COP of the system 10 in FIG. 7 includes reducing a compressor pressure ratio and increasing pressure ratio across the turbine 250. Also, an important criterion for the power generation system 10 of FIG. 7 is that the ratio of the heat H1 applied to the generator 206 (i.e., the capacity of heat rejection heat exchanger 110 capacity of the VCR circuit 100) to the heat H3 removed in the absorber 202 should exceed (1/COP)+1, where COP is the coefficient of performance of the VCR circuit 100.

With regard to FIG. 7, the function and operation of the second portion of the AR circuit 200 during operation of the system 10 is as follows. Vapor-state second refrigerant at the fifth/high temperature and the fourth/high pressure flows to the turbine 250 from the first portion of the AR circuit 200 (i.e., from the generator 206 of the first heat exchanger unit 14 of the thermo-compressor 12). The vapor-state second refrigerant is expanded in the turbine 250, which rotates the drive shaft 254 causing the power generator 252 to generate power. The vapor-state second refrigerant at the third/low pressure and the third/low temperature then flows out from the turbine 250 to the absorber 202 of the first portion of the AR circuit 200 (i.e., into the thermo-compressor 12) and through the first portion of the AR circuit 200 (i.e., the thermo-compressor 12) as previously described. The vapor-state second refrigerant then flows out from the generator 206 of the first portion of the AR circuit 200 (i.e., out from the first heat exchanger unit 14 and the thermo-compressor 12) to the turbine 250 at which point the above-described process repeats. In the exemplary system 10 of FIG. 7, the pressure at the exit of the turbine 250 does not depend on the heat sink temperature and can therefore generate more power than existing power generation systems operating under the same conditions.

The system 10 decouples compressor saturated suction temperature (SST) of the compressor 106 of the VCR circuit 100 from the evaporating temperature of the heat absorption heat exchanger 216 of the AR circuit 200. The compressor suction pressure of the compressor 106 of the VCR circuit 100 is decoupled from the low evaporating pressure in the heat absorption heat exchanger 216 of the AR circuit 200.

The amount of energy and/or power input utilized to operate the system 10 is the sum of the compressor power and the pump power. The heat absorption heat exchanger 216 capacity of the AR circuit 200 is proportional to the pump power. The major energy input for the AR circuit 200 is in the generator 206 and, therefore, the generator 206 utilizing the waste heat from the VCR heat rejection heat exchanger 110 is an effective way to reduce the amount of energy that the AR circuit 200 utilizes during operation.

A coefficient of performance (COP) of the AR circuit 200 is the ratio of heat absorption heat exchanger capacity to the power input in the generator 206. A COP of the VCR circuit 100 is the ratio of the heat absorption heat exchanger capacity to the power input. Provided that the ratio of pump power to compressor power is small, the COP of the system 10 is proportional to a product of COP of the VCR circuit 100 plus a unit multiplied by the COP of the AR circuit 200. The system 10 is configured to maintain a high COP of the VCR circuit 100 at elevated suction pressure and a decent COP of the AR circuit 200 at the lowest operating evaporating temperature.

In some examples, one of the heat absorption heat exchangers 102, 216 operates at a low temperature and the other heat absorption heat exchanger 102, 216 operates at a high temperature, which is higher than the low temperature. In examples, the pump 204 deals with the higher-pressure differential between the absorber 202 and the generator 206, and the amount of power necessary to pump the liquid-state refrigerant/absorbent solution is small compared with the amount of power that would be necessary to pump fluid in a vapor-state. The pump 204 also provides flow rate balancing capacities of the VCR circuit 100 and the AR circuit 200.

In examples, the compressor 106 is configured to operate at a saturated suction temperature (SST) that (i) is higher than the evaporating temperature of the AR circuit 200 and/or (ii) provides a best flow capacity and power value. In other examples, the compressor 106 operates at an elevated SST and a discharge pressure (i) equivalent to the temperature at the VCR heat rejection heat exchanger 110 or (ii) providing highest pumping capacity and COP of the compressor 106. In some cases, the absorption of heat H2 by the first refrigerant in the VCRC heat absorption heat exchanger 102 is used to elevate the compressor suction pressure.

The VCR circuit 100 may be configured as and/or operate as a sub-critical circuit, a trans-critical circuit, or a super-critical circuit. The condensing temperature of the sub-critical VCR circuit 100 dictates the temperature level in the generator 206. In the trans-critical VCR circuit 100 and the super-critical VCR circuit 100, the discharge temperatures of the compressor 106 of the VCR circuit 100 dictate the temperature levels in the generator 206. Additionally, the VCR circuit 100 and the AR circuit 200 are configured to enable the highest temperatures in the absorber 202 as possible. Considering all of the above, the trans-critical VCR circuit 100 may be configured. In one example, the VCR circuit 100 operates as a sub-critical circuit. In another example, the VCR circuit 100 operates as a trans-critical circuit and the heat rejection heat exchanger 110 is configured as a gas cooler. In a further example, the VCR circuit 100 operates as a super-critical circuit, the VCRC heat rejection heat exchanger 110 is configured as a gas cooler, and the VCRC heat absorption heat exchanger 102 operates above the liquid-vapor critical point of the pressure-temperature curve of the first refrigerant. At higher temperatures, the vapor-state first refrigerant cannot be liquefied by pressure alone.

The system 10 may be used in various applications, non-limiting examples of which include (i) a refrigeration system or a power generation system powered by low grade heat applied to the VCR heat absorption heat exchanger 102 and (ii) a heat pump, an air conditioning system, and/or a refrigeration system that provides heating or cooling waste heat in the VCRC heat absorption heat exchanger 102, cooling two heat sources (e.g., the first heat source and the second heat source) taking into consideration the available heat load for the VCRC heat absorption heat exchanger 102, and/or cooling one or more heat sources using the VCRC heat absorption heat exchanger 216 and heating another source using the ARC heat rejection heat exchanger 110.

Various examples/embodiments are described herein for various apparatuses, systems, and/or methods. Numerous specific details are set forth to provide a thorough understanding of the overall structure, function, manufacture, and use of the examples/embodiments as described in the specification and illustrated in the accompanying drawings. It will be understood by those skilled in the art, however, that the examples/embodiments may be practiced without such specific details. In other instances, well-known operations, components, and elements have not been described in detail so as not to obscure the examples/embodiments described in the specification. Those of ordinary skill in the art will understand that the examples/embodiments described and illustrated herein are non-limiting examples, and thus it can be appreciated that the specific structural and functional details disclosed herein may be representative and do not necessarily limit the scope of the embodiments.

Reference throughout the specification to "examples, "in examples," "with examples," "various embodiments," "with embodiments," "in embodiments," or "an embodiment," or the like, means that a particular feature, structure, or characteristic described in connection with the example/embodiment is included in at least one embodiment. Thus, appearances of the phrases "examples, "in examples," "with examples," "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more examples/embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of examples/embodiments.

"One or more" includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first element could be termed a second element, and, similarly, a second element could be termed a first element, without departing from the scope of the various described embodiments. The first element and the second element are both element, but they are not the same element.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Joinder references (e.g., attached, coupled, connected, and the like) are to be construed broadly and may include intermediate members between a connection of elements, relative movement between elements, direct connections, indirect connections, fixed connections, movable connections, operative connections, indirect contact, and/or direct contact. As such, joinder references do not necessarily imply that two elements are directly connected/coupled and in fixed relation to each other. Connections of electrical components, if any, may include mechanical connections, electrical connections, wired connections, and/or wireless connections, among others. Uses of "e.g." and "such as" in the specification are to be construed broadly and are used to provide non-limiting examples of embodiments of the disclosure, and the disclosure is not limited to such examples.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

All matter contained in the above description or shown in the accompanying drawings shall be interpreted as illustrative only and not limiting. Changes in detail or structure may be made without departing from the present disclosure.

It should be understood that a controller, a system, and/or a processor as described herein may include a conventional processing apparatus known in the art, which may be capable of executing preprogrammed instructions stored in an associated memory, all performing in accordance with the functionality described herein. To the extent that the methods described herein are embodied in software, the resulting software can be stored in an associated memory and can also constitute means for performing such methods. Such a system or processor may further be of the type having ROM, RAM, RAM, and ROM, and/or a combination of non-volatile and volatile memory so that any software may be stored and yet allow storage and processing of dynamically produced data and/or signals.

It should be further understood that an article of manufacture in accordance with this disclosure may include a non-transitory computer-readable storage medium having a computer program encoded thereon for implementing logic and other functionality described herein. The computer program may include code to perform one or more of the methods disclosed herein. Such embodiments may be configured to execute via one or more processors, such as multiple processors that are integrated into a single system or are distributed over and connected together through a communications network, and the communications network may be wired and/or wireless. Code for implementing one or more of the features described in connection with one or more embodiments may, when executed by a processor, cause a plurality of transistors to change from a first state to a second state. A specific pattern of change (e.g., which transistors change state and which transistors do not), may be dictated, at least partially, by the logic and/or code.

What is claimed is:

1. A thermal system, comprising:

a vapor compression refrigeration circuit for conducting a first refrigerant, the vapor compression refrigeration circuit including:

a first heat rejection heat exchanger;

a first heat absorption heat exchanger;

a compressor disposed between the first heat absorption heat exchanger and the first heat rejection heat exchanger; and an expansion valve disposed between and connected to the first heat rejection heat exchanger and the first heat absorption heat exchanger;

an absorption refrigeration circuit for conducting a second refrigerant and an absorbent, the absorption refrigeration circuit including:

a generator;

an absorber;

a pump disposed between and connected to the absorber and the generator;

a throttling valve disposed between and connected to the generator and the absorber;

a second heat rejection heat exchanger connected to the generator; and a second heat absorption heat exchanger connected to the absorber, the second heat rejection heat exchanger disposed between the generator and the second heat absorption heat exchanger, the second heat absorption heat exchanger disposed between the second heat rejection heat exchanger and the absorber; and a first heat exchanger unit including the generator and the first heat rejection heat exchanger;

wherein the generator and the first heat rejection heat exchanger are integrated with one another within the first heat exchanger unit such that heat emitted by the first heat rejection heat exchanger is transferred to the generator; and wherein the second heat absorption heat exchanger operates at a low temperature and the first heat absorption heat exchanger operates at a high temperature, which is higher than the low temperature.

2. The system according to claim 1, further comprising a second heat exchanger unit including the absorber and the first heat absorption heat exchanger, wherein the absorber and the first heat absorption heat exchanger are integrated with one another within the second heat exchanger unit such that heat emitted by the absorber is transferred to the first heat absorption heat exchanger cooling the absorber.

3. The system according to claim 1, further comprising another heat exchanger unit including the second heat rejection heat exchanger and the first heat absorption heat exchanger, wherein the second heat rejection heat exchanger and the first heat absorption heat exchanger are integrated with one another within the another heat exchanger unit such that heat emitted by the second heat rejection heat exchanger is transferred to the first heat absorption heat exchanger cooling the second heat rejection heat exchanger.

4. The system according to claim 1, wherein the first refrigerant and the second refrigerant have the same composition.

5. The system according to claim 1, wherein:

the vapor compression refrigeration circuit is a sub-critical vapor compression refrigeration circuit; or the vapor compression refrigeration circuit is a trans-critical vapor compression refrigeration circuit and the first heat rejection heat exchanger is a gas cooler.

6. The system according to claim 1, wherein the vapor compression refrigeration circuit is a super-critical vapor compression refrigeration circuit, the first heat rejection heat exchanger is a gas cooler, and the first heat absorption heat exchanger is configured to operate above a critical point of the first refrigerant.

7. The system according to claim 1, further comprising a thermo-compressor including the first heat exchanger unit, the pump, the throttling valve, and the absorber.

8. The system according to claim 7, wherein:

the thermo-compressor includes a second heat exchanger unit including the absorber and the first heat absorption heat exchanger; and the absorber and the first heat absorption heat exchanger are integrated with one another within the second heat exchanger unit such that heat emitted by the absorber is transferred to the first heat absorption heat exchanger cooling the absorber.

9. The system according to claim 1, wherein the absorption refrigeration circuit further includes a receiver connected to the second heat rejection heat exchanger, the receiver disposed between the second heat rejection heat exchanger and the second heat absorption heat exchanger.

10. The system according to claim 1, wherein the absorption refrigeration circuit further includes a second expansion valve connected to the second heat absorption heat exchanger, the second expansion valve disposed between the second heat rejection heat exchanger and the second heat absorption heat exchanger.

11. The system according to claim 10, wherein the absorption refrigeration circuit further includes a receiver disposed between and connected to the second expansion valve and the second heat absorption heat exchanger.

12. The system according to claim 1, wherein the vapor compression refrigeration circuit further includes a suction accumulator disposed between and connected to the first heat absorption heat exchanger and the compressor.

13. The system according to claim 1, further comprising a four-way valve configured to switch at least a portion of the absorption refrigeration circuit to a cooling mode and a heating mode, wherein the four-way valve includes:

an inlet connected to the generator;

an outlet connected to the absorber;

a first port connected to the second heat rejection heat exchanger; and a second port connected to the second heat absorption heat exchanger.

14. The system according to claim 13, wherein:

when in the cooling mode, the four-way valve connects the inlet to the first port and connects the second port to the outlet such that the second refrigerant flows sequentially through the generator, the four-way valve, the second heat rejection heat exchanger, the second heat absorption heat exchanger, the four-way valve, and the absorber; and when in the heating mode, the four-way valve connects the inlet to the second port and connects the first port to the outlet such that the second refrigerant flows sequentially through the generator, the four-way valve, the second heat absorption heat exchanger, the second heat rejection heat exchanger, the four-way valve, and the absorber.

15. The system according to claim 1, further comprising an outdoor unit including the second heat rejection heat exchanger, an indoor unit including the second heat absorption heat exchanger, and a four-way valve configured to switch at least a portion of the absorption refrigeration circuit to a cooling mode and a heating mode, wherein:

when in the cooling mode, the outdoor unit operates as a heat rejection heat exchanger and the indoor unit operates as a heat absorption heat exchanger; and when in the heating mode, the outdoor unit operates as an heat absorption heat exchanger and the indoor unit operates as a heat rejection heat exchanger.

16. A thermal system, comprising:

a vapor compression refrigeration circuit for conducting a first refrigerant, the vapor compression refrigeration circuit including:

a heat rejection heat exchanger;

a heat absorption heat exchanger;

a compressor disposed between the heat absorption heat exchanger and the heat rejection heat exchanger; and an expansion valve disposed between and connected to the heat rejection heat exchanger and the heat absorption heat exchanger;

an absorption refrigeration circuit for conducting a second refrigerant and an absorbent, the absorption refrigeration circuit including:

a generator;

an absorber;

a pump disposed between and connected to the absorber and the generator;

a throttling valve disposed between and connected to the generator and the absorber; and a turbine disposed between and connected to the generator and the absorber;

a common drive shaft connected to the compressor, the pump, and the turbine; and a heat exchanger unit including the generator and the heat rejection heat exchanger;

wherein the generator and the heat rejection heat exchanger are integrated with one another within the heat exchanger unit such that heat emitted by the heat rejection heat exchanger is transferred to the generator.

17. The system according to claim 16, further comprising a power generator connected to the common drive shaft, wherein the turbine and the power generator are connected to one another via the common drive shaft.

18. The system according to claim 1, wherein the first heat rejection heat exchanger is a condenser.

19. The system according to claim 1, wherein the first heat absorption heat exchanger is configured to operate at a higher evaporating temperature than the second heat absorption heat exchanger.

20. A thermal system, comprising:

a vapor compression refrigeration circuit for conducting a first refrigerant, the vapor compression refrigeration circuit including:

a first heat rejection heat exchanger;

a first heat absorption heat exchanger;

a compressor disposed between the first heat absorption heat exchanger and the first heat rejection heat exchanger; and an expansion valve disposed between and connected to the first heat rejection heat exchanger and the first heat absorption heat exchanger;

an absorption refrigeration circuit for conducting a second refrigerant and an absorbent, the absorption refrigeration circuit including:

a generator;

an absorber;

a pump disposed between and connected to the absorber and the generator;

a throttling valve disposed between and connected to the generator and the absorber;

a second heat rejection heat exchanger connected to the generator; and a second heat absorption heat exchanger connected to the absorber, the second heat rejection heat exchanger disposed between the generator and the second heat absorption heat exchanger, the second heat absorption heat exchanger disposed between the second heat rejection heat exchanger and the absorber;

a first heat exchanger unit including the generator and the first heat rejection heat exchanger; and a four-way valve configured to switch at least a portion of the absorption refrigeration circuit to a cooling mode and a heating mode, the four-way valve including:

an inlet connected to the generator;

an outlet connected to the absorber;

a first port connected to the second heat rejection heat exchanger; and a second port connected to the second heat absorption heat exchanger;

wherein the generator and the first heat rejection heat exchanger are integrated with one another within the first heat exchanger unit such that heat emitted by the first heat rejection heat exchanger is transferred to the generator.

* * * * *